United States Patent [19]

Hotta et al.

[11] Patent Number: 4,617,224

[45] Date of Patent: Oct. 14, 1986

[54] THERMAL TRANSFER RECORDING MEDIUM

[75] Inventors: Yuji Hotta, Hachioji; Takao Abe, Tokyo; Fumio Ishii, Akishima; Shigehiro Kitamura, Hachioji; Kunihiro Koshizuka, Hino; Masaki Nakamura, Hachioji, all of Japan

[73] Assignee: Konishiroku Photo Industry Co., Ltd., Tokyo, Japan

[21] Appl. No.: 661,069

[22] Filed: Oct. 15, 1984

[30] Foreign Application Priority Data

Oct. 17, 1983 [JP] Japan ..... 58-192545

[51] Int. Cl.[4] ..... B41M 5/26

[52] U.S. Cl. ..... 428/212; 346/204; 428/195; 428/211; 428/215; 428/216; 428/484; 428/488.1; 428/488.4; 428/913; 428/914

[58] Field of Search ..... 346/200, 204, 208, 226; 428/195, 203, 204, 207, 484, 488.1, 488.4, 913, 914, 211, 212, 215, 216

[56] References Cited

U.S. PATENT DOCUMENTS 4,500,896 2/1985 Kubo et al. ..... 428/488.4

FOREIGN PATENT DOCUMENTS 0182492 11/1982 Japan ..... 428/195
0217392 12/1983 Japan ..... 428/488.1
0064389 4/1984 Japan ..... 428/914
0073995 4/1984 Japan ..... 428/913

*Primary Examiner*—Bruce H. Hess
*Attorney, Agent, or Firm*—Frishauf, Holtz, Goodman & Woodward

[57] ABSTRACT

A thermal transfer recording medium having a support and two coloring agent layers provided on the same side thereof, in which the first coloring agent layer is a layer containing a resin and a coloring agent coated on the support and the second layer is a layer containing a heat-fusible material and a coloring agent coated on the first layer, and the respective coloring agents in the two layers have isochromatic color tone. The thermal transfer recording medium provides low energy printing at high speed with little decrease in its density even after being used for many copies, thus permitting high density dye transfer images to be obtained over very many times.

20 Claims, 1 Drawing Figure

THERMAL TRANSFER RECORDING MEDIUM

BACKGROUND OF THE INVENTION

1. Field of the Invention

This invention relates to a thermal transfer recording medium which is usable repeatedly, and more particularly to a thermal transfer recording medium in which the density thereof is not substantially lowered even when used repeatedly and printing can be made with relatively low energy, the speed and density thereof are high and the resolution power thereof is also excellent.

2. Description of the Prior Art

As for the thermal transfer recording media with the purpose of being used well repeatedly, there is, as an example, disclosure of an invention in Japanese Patent Publication Open to Public Inspection (hereinafter called Japanese Patent O.P.I. Publication) No. 68253/1979. The techniques of this invention is that a fine porous layer is made of a resin and the pores thereof are impregnated with a thermally sensitive ink.

Therein, a dye transfer image is substantially low in density, and there is, therefore, required substantially high energy to obtain a high density dye transfer image; and besides the edges of a printed image will lack clearness even if a high density dye transfer image should be obtained by applying to it high energy. Another technique similar to the above is disclosed in Japanese Patent O.P.I. Publication No. 105579/1980 and the same defects are observed therein.

As for the thermal transfer recording media capable of solving the abovementioned defects, there is a technique disclosed in Japanese Patent O.P.I. Publication No. 36698/1982 in which a resin layer is interposed between an ink layer, i.e., a coloring agent layer and a support, and the abovementioned ink layer is impregnated with a low melting resin having the softening or melting point of from 60° to 120° C. According to this technique, the adhesion of the ink layer to the support may be improved and high density printing may certainly be performed by using relatively low energy; however, to the contrary, this thermal transfer recording medium has such defect that a dye transfer image is so seriously lowered in density, that it is of no practical use.

OBJECTS OF THE INVENTION

It is an object of the invention to provide a thermal transfer recording medium in which low energy printing can be performed at high speed and the density thereof is little decreased even when used well many times, so that high density dye transfer images are obtained extending over very many times.

Other and further objects of the invention will become obvious from the following description.

SUMMARY OF THE INVENTION

The object of the invention can be achieved by a thermal transfer recording medium having a support and two coloring agent layers provided on the same side thereof, in which the first coloring agent layer is a layer containing a resin and a coloring agent coated on the support and the second layer is a layer containing a heat-fusible material and a coloring agent coated on the first layer, and the respective coloring agents in the two layers have isochromatic color tone.

DESCRIPTION OF THE PREFERRED EMBODIMENTS

Figure 1:
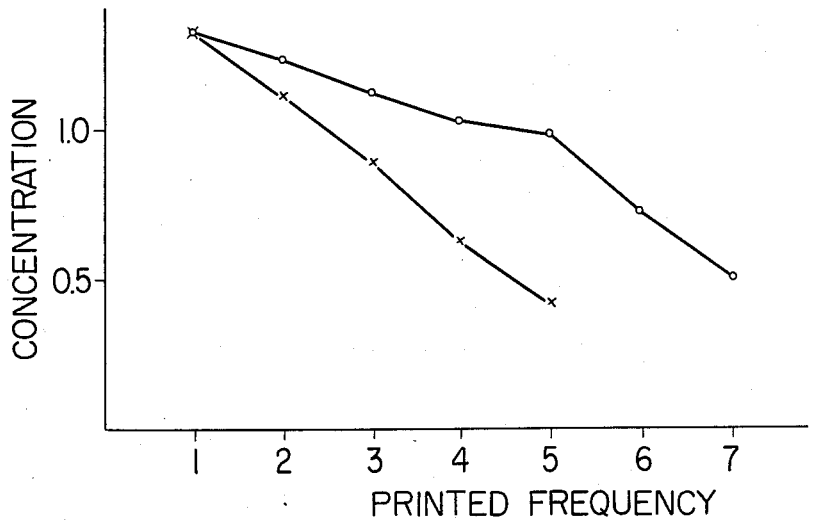
FIG. 1 indicates the relation between the number of printing times of a thermal transfer recording medium and the density of a dye transfer image thereof. In this figure, the line marked with circles shows the case of using a sample material of the invention and the line marked with crosses shows the case of using a sample material for the comparison purpose.

In this invention, the second coloring agent layer (the layer far from the support) is a heat-fusible material containing layer. The heat-fusible materials which are to be used therein are the solid or semisolid materials having a melting point of from 40° C. to 120° C. (measured by a Model MPJ-2 mfd. by Yanagimoto). The typical examples thereof are a group of wax including plant wax such as carnauba wax, Japan wax, ouricury wax, esparto wax and the like; an animal wax such as shellac wax, spermaceti wax and the like; beeswax, insect wax and the like; a petroleum wax such as paraffin wax, microcrystalline wax, an ester wax, an oxidized wax and the like; a mineral wax such as montan wax, ozokerite wax, ceresin wax and the like; a group of higher fatty acids including palmitic acid, stearic acid, margaric acid, behenic acid and the like; a group of higher alcohols including palmityl alcohol, stearyl alcohol, behenyl alcohol, margaryl alcohol, myricyl alcohol, eicosanol and the like; a group of higher fatty acid esters including cetyl palmitate, myricyl palmitate, cetyl stearate, myricyl stearate and the like; a group of amides including acetamide, propionic acid amide, palmitic acid amide, stearic acid amide, amide wax and the like; a group of rosin derivatives such as an ester gum, rosin maleic acid resin, rosin phenol resin, hydrogenated rosin and the like; a group of macromolecular compounds having a softening point of from 50° C. to 120° C., including phenol resin, terpene resin, cyclopentadien resin, an aromatic resin and the like; a group of higher amines including stearylamine, behenylamine, palmitine amine and the like; and a group of polyethylene oxides including polyethylene glycol 4000, polyethylene glycol 6000 and the like. These may be used independently or in combination. Inter alia, higher amides such as palmitic acid amide, stearic acid amide, oleic acid amide, amide wax and the like are particularly preferred.

In this invention, the first coloring agent layer (the layer close to the support) is a resin containing layer. The resins which are to be used are those each having a softening point of 120° C. or higher (measured by a ring and ball method). For example, hydrophilic polymers and hydrophobic polymers either may be used. As for the hydrophilic polymers, transparent or translucent hydrophilic colloids are typically used. They are, for example, natural substances and the derivatives thereof including proteins such as gelatin and the derivatives thereof, cellulose derivatives, casein and the like, and polysaccharides such as starch; synthetic water-soluble polymers including water-soluble polyvinyl compounds such as polyvinyl alcohol, polyvinyl pyrolidone, acryl amide polymers and the like; and besides, vinyl polymer latexes, polyurethane latexes and the like. As for the hydrophobic polymers, the transparent ones are preferred to use. The synthetic polymers described in U.S. Pat. Nos. 3,142,586, 3,143,386, 3,062,674, 3,220,844, 3,287,289 and 3,411,911 may be given as the examples thereof. The preferred polymers include, for example, polyvinyl butyral, polyacrylamide, cellulose acetate butyrate, cellulose acetate phthalate, ethyl cellulose, cellulose acetate, polyvinyl pyrolidone, polystyrene, polyvinyl acetate, vinyl chloride - vinyl acetate copolymer, vinyl chloride - vinyl acetate - maleic acid - terpolymer, dextrin, sodium alginate, polymethyl methacrylate, polyisobutylene and the like. In this invention, these resins may be used independently or in combination.

Dissimilar to a customary coloring agent layer, the resin containing layers relating to this invention are not wholly transferred to any recording sheet when recording upon heating.

In the coloring agent layers of this invention, the expression, "tones are isochroous", means that, through a visual observation, each color has the same tone in a hue. For example, if the difference of the dominant absorption wavelength from each other tone is within the range of 10 nm and preferably 5 nm, such color tones are isochroous.

Coloring agents to be contained in a coloring agent layer of the invention may suitably be selected from the coloring agents conventionally known such as direct dyes, acid dyes, basic dyes, disperse dyes, oil dyes and the like. As for the coloring agents to be used in the heat-fusible substance containing layer of the invention, those capable of transferring (or, moving) together with a heat-fusible substance may be used; therefore, pigments, besides the above, may also be used. On the other hand, as for the coloring agents to be used in the resin containing layers of the invention, it is preferred to select those from the coloring agents capable of transferring (or, moving) together with the heat-fusible substance of the abovementioned heat-fusible substance containing layer and, inter alia, basic dyes and oil dyes are particularly preferred.

The content of such coloring agents in the heat-fusible substance containing layer of the invention is from 5 to 80% by weight to the heat-fusible substance and more preferably from 10 to 30%. On the other hand, the content of the coloring agents in a resin containing layer of the invention is from 30 to 120% by weight to the resin and more preferably from 80 to 100%.

Any well-known additive may also be added to the coloring agent layers of the invention. For example, the heat conductive materials include such a high heat conductive metal as aluminium, copper, zinc and the like. These heat conductive materials improve a heat conductive effect so as to fuse, soften or sublimate a coloring agent layer by heat.

With respect to the thermal transfer recording media of the invention, there are the conventional techniques well known to those skilled in the art which are suitable to coat a color material over to a support such as a sheet of polymer film. These may also be used in the invention. For example, a coloring agent layer is formed by hot-melt-coating the composite thereof or by solvent-coating a coating liquid comprising dissolving or dispersing the composite in a suitable solvent. As for the methods of coating a coloring agent layer of the invention, any of well-known techniques can be adopted such as reverse-roll coater method, extruding coater method, gravure coater method, wire bar coating method and the like.

The heat-fusible substance containing layers of the invention as well as the resin containing layers thereof may satisfactorily be used when they are 0.5 to 5$\mu$ in thickness.

The thermal transfer recording media of the invention may also be provided with the other component layers including, for example, a subbing layer such as a layer for improving the adhesion, an inter layer provided between a heat-fusible substance containing layer and a resin containing layer so as not to disturb the heat-transfer of coloring agents in the resin containing layer, an uppercoating layer such as a layer comprising a heat-fusible substance, and the like. The heat-fusible substance containing layers of the invention can satisfactorily be used if they substantially comprise a heat-fusible substance, and may also be allowed to contain a resin, provided that the effect of the invention cannot be affected by the resins. The resin containing layers of the invention can satisfactorily be used if they substantially comprise a resin, and may also be allowed to contain a heat-fusible substance, provided that the effect of the invention cannot be affected thereby.

A support is the base member of a thermal transfer recording medium of the invention and it is desired that it have substantial heat-resistivity, dimensional stability and surface smoothness.

Heat resistivity, strength and dimensional stability of the support are desired so that the support cannot be softened or plasticized by the heat source such as a thermal head or the like. Surface smoothness is desirably to be enough to display an excellent transfer ratio of the heat-fusible substance containing layer on the support. The satisfactory smoothness is not less than 100 sec. When smoothness is tested by the method of JIS P 8119 and when it is not less than 300 sec, a reproducible image may be obtained at a relatively higher transfer ratio. Such suitable materials include, for example, such a paper as a plain paper, condenser paper, laminated paper, coated paper and the like; a film made of such a resin as polyester, polycarbonate, polyethylene, polystyrene, polypropylene, polyimide and the like, a paper-resin film complex; and such a metal sheet as aluminium foil. The thickness of such supports is ordinarily not thicker than about 60$\mu$ and more preferably from 3 to 20$\mu$ from the viewpoint of obtaining an excellent heat conductivity. In addition, in the thermal transfer recording media of the invention, any constitution of the back of the support may be selected as an option.

According to this invention, a thermal transfer recording medium comprising two coloring agent layers is so constituted that one coloring agent layer far from the support (second coloring agent layer) is in a heat-fusible substance containing layer and the other one close to the support (first coloring agent layer) is in a resin containing layer and that the coloring agents of the heat-fusible substance containing layer and of the coloring agents of the resin containing layer are isochroous. The objects of the invention first written can therefore be achieved. In particular, such advantages can be enjoyed that the coloring agents of the heat-fusible substance containing layer are transferred at each time of recording to such a recording sheet as a plain paper to render thereon a dye transfer image having a considerably high density, so that the reduced amount of the coloring agents of the heat-fusible substance containing layer is replenished by the amount moved (or diffused) of the coloring agents of the resin containing layer so that the image density can hardly be lowered even when recorded repeatedly.

EXAMPLE

In the following examples are described several preferred embodiments to illustrate the invention. However, it is to be understood that the invention is not intended to be limited to the specific embodiments.

In the following description, the word, "part", means a "part by weight".

EXAMPLE 1

A coating solution for a resin containing layer was prepared by dissolving 100 parts of polyvinyl butyral (Softening point: 120° C.) and 80 parts of C.I. Solvent Black 7 in 1,000 parts of methyl ethyl ketone. This coating solution was coated by means of a wire bar over a polyester film support of 6μ in thickness and dried. Thus, a resin containing layer of 1μ in thickness was prepared.

On the other hand, another coating solution for a heat-fusible substance containing layer was prepared by dissolving 100 parts of stearamide (Melting point: 102°–104° C.) and 10 parts of carbon black (RAVEN 1250, mfd. by Columbia Carbon Co.) in 500 parts of toluene. This coating solution was coated by means of a wire bar over the described resin containing layer and dried. Thus, a heat-fusible substance containing layer of 2μ in thickness was prepared.

Thus prepared sample of a thermal transfer recording medium of the invention was superposed on a sheet of plain paper (i.e. a sheet of white paper with Bekk smoothness of 180 sec) and an energy of 0.5 mj/dot was applied thereto by means of a thermal printer (i.e., a trial machine provided with a thin-film type line thermal head of 8 dot/mm in exothermic element density) and then thermally transferred. This procedure was repeated up to 7 times over.

On the other hand, a comparative sample (1) was prepared in the same manner as in the abovementioned sample of the invention, except that the coloring agents were removed from the resin containing layer, and, similar to the above, the procedure of printing was repeated a number of times over. Resultantly, as shown in FIG. 1, the comparative sample (1) showed a remarkable lowering of the density of the dye transfer images as the recording was repeated, while the sample of the invention showed that the lowering of the dye transfer image density was restrained even when recording repeatedly.

COMPARATIVE EXAMPLE 1

According to the Example 1 given in Japanese Patent O.P.I. Publication No. 68253/1979, a coating solution comprising 10 parts of vinyl chloride - vinyl acetate copolymer, 7 parts of carnauba wax, 11 parts of castor wax, 4 parts of carbon black, 51 parts of ethyl acetate and 17 parts of toluene was solvent-coated over a sheet of raw carbon paper and was then processed as described in the abovementioned Japanese Patent Publication. Thus, Comparative Sample (2) was prepared.

Further, according to the example given in Japanese Patent O.P.I. Publication No. 105579/1980, a coating solution comprising 20 parts of vinyl chloride - vinyl acetate copolymer, 40 parts of table salt, 2 parts of p,p'-oxy-bis(benzene sulfonyl hydrazide), 60 parts of methyl ethyl ketone, and 40 parts of heptane was solvent-coated over a sheet of polyester film of 12μ in thickness and was then processed as described of the abovementioned Example. Thus, Comparative Example (3) having a finely porous ink layer was prepared.

With respect to these Comparative Examples (2) and (3), a series of printing was tried repeatedly on plain paper in the same manner as in Example 1 given above. Both of these comparison examples could produce nothing every dye transfer image from the first one on that was so low in density that all of them cannot be used practically. When the inventors tried to make these comparative samples (2) and (3) each produce the density similar to that obtained from the sample of the invention, it was required to apply about 2.4 times higher than the original electric power. In addition, the edge sharpness of thus obtained dye transfer images was markedly inferior to those of the sample of the invention.

What is claimed is:

1. A thermal transfer recording medium comprising a support, a first coloring agent layer containing a coloring agent and a resin having a softening point of 120° C. or more coated on said support, and a second coloring agent layer containing a coloring agent and a heat-fusible substance having a melting point in the range of from 40° C. to 120° C. coated on said first layer, said coloring agents contained in said first and second layers having substantially isochromatic tone.

2. The thermal transfer recording medium of claim 1, wherein the difference between the dominant absorption wavelengths of said coloring agents is within the range of 10 nm.

3. The thermal transfer recording medium of claim 2, wherein the difference between the dominant absorption wavelengths of said coloring agents is within the range of 5 nm.

4. The thermal transfer recording medium of claim 2, wherein said coloring agent in said first coloring agent layer if C.I. Solvent Black 7 and said coloring agent insaid second coloring agent is carbon black.

5. The thermal transfer recording medium of claim 1, wherein the coloring agent of said second layer is selected from the group consisting of direct dyes, basic dyes, disperse dyes, acid dyes, oil-soluble dyes, and pigments.

6. The thermal transfer recording medium of claim 5, wherein the amount of the coloring agent of said second layer is within the range of from 5% to 80% by weight of the heat-fusible substance.

7. The thermal transfer recording medium of claim 6, wherein the amount of the coloring agent of said second layer is within the range of from 10% to 30% by weight of the heat-fusible substance.

8. The thermal transfer recording medium of claim 1, wherein the coloring agent of said first layer is selected from the group consisting of basic dyes and oil-soluble dyes.

9. The thermal transfer recording medium of claim 8, wherein the amount of the coloring agent of said first layer is within the range of from 30% to 120% by weight of the resin.

10. The thermal transfer recording medium of claim 9, wherein the amount of the coloring agent of said first layer is within the range of from 80% to 100% by weight of the resin.

11. The thermal transfer recording medium of claim 1, wherein said first layer has a thickness in the range of from 0.5 μm to 5 μm.

12. The thermal transfer recording medium of claim 1, wherein said second layer has a thickness in the range of from 0.5 μm to 5 μm.

13. The thermal transfer recording medium of claim 1, wherein the support has a thickness in the range of from 3 μm to 2 μm.

14. The thermal transfer recording medium of claim 1 having an additional layer selected from the group consisting of a subbing layer, an intermediate layer and an over-coat layer.

15. The thermal transfer recording medium of claim 1, wherein said resin in said first coloring agent layer is a hydrophilic transparent or translucent colloid polymer or a hydrophobic transparent polymer.

16. The thermal transfer recording medium of claim 15, wherein said resin is polyvinyl butyral hydrophobic polymer.

17. The thermal transfer recording medium of claim 1, wherein said heat fusible substance in said second coloring agent layer is a wax.

18. The thermal transfer recording medium of claim 17, wherein said resin is stearamide.

19. The thermal transfer recording medium of claim 1, wherein said support is heat-resistant, dimensionally stable and smooth surfaced.

20. The thermal transfer recording medium of claim 19, wherein said support is paper.

* * * * *